US008503898B2

(12) United States Patent
Okamoto

(10) Patent No.: US 8,503,898 B2
(45) Date of Patent: Aug. 6, 2013

(54) FIXING DEVICE AND IMAGE FORMING APPARATUS

(75) Inventor: Masami Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 240 days.

(21) Appl. No.: 13/033,275

(22) Filed: Feb. 23, 2011

(65) Prior Publication Data

US 2011/0222879 A1 Sep. 15, 2011

(30) Foreign Application Priority Data

Mar. 9, 2010 (JP) ..... 2010-051647

(51) Int. Cl.
*G03G 15/20* (2006.01)

(52) U.S. Cl.
USPC ..... 399/67; 399/329; 399/331; 219/216

(58) Field of Classification Search
USPC ..... 399/67, 329, 331
See application file for complete search history.

(56) References Cited

U.S. PATENT DOCUMENTS

| | | | |
|---|---|---|---|
| 6,239,864 | B1 | 5/2001 | Okamoto |
| 6,394,446 | B1 | 5/2002 | Okamoto |
| 6,411,795 | B2 | 6/2002 | Okamoto |
| 7,054,570 | B2 | 5/2006 | Kishi et al. |
| 7,116,923 | B2 | 10/2006 | Kishi et al. |
| 7,130,555 | B2 | 10/2006 | Kishi et al. |
| 7,209,675 | B2 | 4/2007 | Matsusaka et al. |
| 7,212,758 | B2 | 5/2007 | Kishi et al. |
| 7,212,759 | B2 | 5/2007 | Kishi et al. |
| 7,239,821 | B2 | 7/2007 | Matsusaka et al. |
| 7,308,216 | B2 | 12/2007 | Kishi et al. |
| 7,333,743 | B2 | 2/2008 | Kishi et al. |
| 7,343,113 | B2 | 3/2008 | Matsusaka et al. |
| 7,356,270 | B2 | 4/2008 | Matsusaka et al. |
| 7,359,653 | B2 | 4/2008 | Okamoto |
| 7,366,432 | B2 | 4/2008 | Kishi et al. |
| 7,373,094 | B2 | 5/2008 | Kishi et al. |
| 7,463,841 | B2 | 12/2008 | Okamoto |
| 7,496,309 | B2 | 2/2009 | Matsusaka et al. |
| 7,515,845 | B2 | 4/2009 | Kishi et al. |
| 7,551,869 | B2 | 6/2009 | Kishi et al. |

(Continued)

FOREIGN PATENT DOCUMENTS

| | | |
|---|---|---|
| JP | 5-173446 | 7/1993 |
| JP | 11-125985 | 5/1999 |

(Continued)

OTHER PUBLICATIONS

U.S. Appl. No. 12/897,254, filed Oct. 4, 2010, Masami Okamoto.

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A fixing device including a rotatable fixing member to fix a toner image on a recording medium, a pressing member to press against the fixing member to form a nip portion therebetween, through which the recording medium passes, and a nip pressure applying mechanism that movably supports the pressing member. The nip pressure applying mechanism presses the pressing member against the fixing member at a predetermined nip pressure during a fixing operation, and draws the pressing member away from the fixing member for a predetermined distance before the fixing operation. The predetermined distance is set depending on a condition for the fixing operation.

8 Claims, 5 Drawing Sheets

U.S. PATENT DOCUMENTS

| | | | | |
|---|---|---|---|---|
| 7,565,087 | B2 | 7/2009 | Matsusaka et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,683,297 | B2 | 3/2010 | Kishi et al. | |
| 7,885,569 | B2 | 2/2011 | Kishi et al. | |
| 2003/0128994 | A1* | 7/2003 | Holubek et al. | 399/45 |
| 2004/0165897 | A1* | 8/2004 | Hooper et al. | 399/44 |
| 2005/0123315 | A1 | 6/2005 | Kishi et al. | |
| 2005/0220467 | A1* | 10/2005 | Takahashi et al. | 399/45 |
| 2006/0051111 | A1 | 3/2006 | Kishi et al. | |
| 2007/0031159 | A1 | 2/2007 | Kishi et al. | |
| 2007/0212085 | A1* | 9/2007 | Mitsuya et al. | 399/45 |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |

FOREIGN PATENT DOCUMENTS

| | | |
|---|---|---|
| JP | 2002-202684 | 7/2002 |
| JP | 2002-311745 | 10/2002 |
| JP | 2006-030869 | 2/2006 |
| JP | 2007-304459 | 11/2007 |
| JP | 4306477 | 5/2009 |

* cited by examiner

FIXING DEVICE AND IMAGE FORMING APPARATUS

CROSS-REFERENCE TO RELATED APPLICATIONS

The present patent application claims priority pursuant to 35 U.S.C. §119 from Japanese Patent Application No. 2010-051647, filed on Mar. 9, 2010, which is hereby incorporated by reference herein in its entirety.

BACKGROUND

1. Field of the Invention

The present invention relates to a fixing device including a nip pressure applying mechanism. In addition, the present invention also relates to an image forming apparatus, such as a copier, a printer, and a facsimile machine, including the fixing device.

2. Description of the Background

In electrophotographic image forming apparatuses such as copiers and laser printers, a toner image is formed on an image bearing member (e.g., a photoconductor) and transferred onto paper. Finally, the toner image is fixed on the paper by a fixing device.

Fixing devices are of two main types: heat-roller-type fixing devices and belt-type fixing devices. In the heat-roller-type fixing device, a fixing roller equipped with a heat source and a pressing roller are in contact with each other at a predetermined pressure. (The portion where the pressing roller is pressed against the fixing roller may be hereinafter referred to as the "nip portion".) In the belt-type fixing device, a fixing belt is stretched across multiple rollers including a fixing roller and a heating roller, and a pressing roller is pressed against the fixing roller at a predetermined pressure with the fixing belt therebetween, thus forming the nip portion. In both types of fixing devices, a paper having a toner image thereon passes through the nip portion and receives heat and pressure therefrom. Thus, the toner image is fixed on the paper.

Both the fixing roller and the pressing roller generally have an elastic layer on their surfaces. When such fixing roller and pressing roller are kept in a static contact state at a specific nip pressure for an extended period of time, the elastic layers may permanently deform and never return to the original state even when the nip pressure is released. Such a nip portion formed with the deformed elastic layers generates noise during fixing operation and produces low-quality images.

Electrophotographic image forming apparatuses have another problem of blistering including paper blistering and toner blistering.

Paper blistering generally occurs when a toner image is fixed on a sheet of paper by application of heat. Upon heating of the paper, moisture inside the paper generates moisture vapor, and the moisture vapor gradually increase its pressure. When the moisture vapor cannot be smoothly discharged from the paper due to the presence of a surface coating layer on the paper, the moisture vapor rapidly expands, causing local blistering within the paper.

Toner blistering generally occurs when a toner image is fixed on paper, especially a coated paper or a paper already having a fixed toner image on the opposite side, by application of heat. Air and moisture existing between toner particles or between toner particles and the paper expand upon heating. Because the expanded air and moisture cannot easily penetrate such coated paper or paper having a fixed toner image on the opposite side, bubbles are generated within the toner image.

In attempting to solve the problem of blistering, Japanese Patent Application Publication No. 2005-215580 proposes a mechanism for separating a pressing roller from a fixing member for a predetermined distance while image formation is not occurring so that the pressing roller will not be heated above a predetermined temperature.

However, disadvantageously, this mechanism takes an unnecessarily long time to bring the pressing roller into contact with the fixing member again to be ready for fixing a next toner image.

SUMMARY

Exemplary aspects of the present invention are put forward in view of the above-described circumstances, and provide a novel fixing device and image forming apparatus that does not cause blistering and does not take an unnecessarily long time to be ready for fixing.

In one exemplary embodiment, a novel fixing device includes a rotatable fixing member to fix a toner image on a recording medium, a pressing member to press against the fixing member to form a nip portion therebetween, through which the recording medium passes, and a nip pressure applying mechanism that movably supports the pressing member. The nip pressure applying mechanism presses the pressing member against the fixing member at a predetermined nip pressure during a fixing operation, and draws the pressing member away from the fixing member for a predetermined distance before the fixing operation. The predetermined distance is set depending on a condition for the fixing operation.

In another exemplary embodiment, a novel image forming apparatus includes the above fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
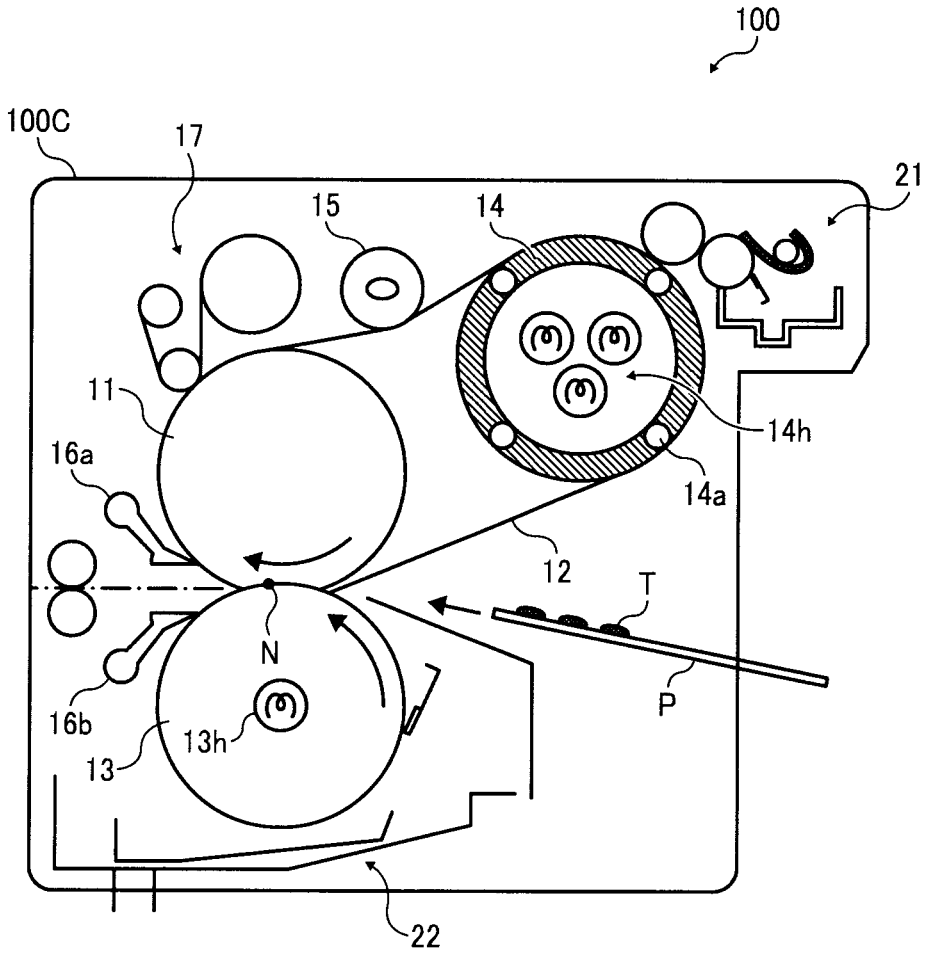
FIG. 1 is a cross-sectional schematic view illustrating a fixing device according to exemplary embodiments of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a cross-sectional schematic view illustrating a fixing device according to exemplary embodiments of the invention.

A fixing device 100 includes a cover 100C, a fixing roller 11, a fixing belt 12, a pressing roller 13, a heating roller 14, separation claws 16*a* and 16*b*, a cleaning mechanism 17, and oil applicators 21 and 22. The fixing belt 12 is stretched across multiple rollers including the fixing roller 11 and the heating roller 14 at a predetermined tension. The pressing roller 13 is rotatably pressed against the fixing roller 11 with the fixing belt 12 therebetween, forming a fixing nip portion N. An edge of the separation claw 16*a* is disposed on the discharging side of the fixing nip portion N adjacent to the fixing belt 12, to prevent a sheet P from winding around the fixing belt 12. An edge of the separation claw 16*b* is disposed on the discharging side of the fixing nip portion N while contacting the pressing roller 13, to prevent the sheet P from winding around the pressing roller 13. The cleaning mechanism 17 cleans the fixing belt 12 by pressing a cleaning web thereto. The oil applicator 21 applies oil to the surface of the fixing belt 12 to improve detachability of the sheet P therefrom. The oil applicator 22 applies oil to the surface of the pressing roller 13 to improve detachability of the sheet P therefrom.

The fixing roller 11 may be a metallic cored roller covered with a silicone rubber layer. The silicone rubber layer may be comprised of, for example, a solid silicone rubber or a foamed silicone rubber. The foamed silicone rubber is more preferable because it absorbs less heat from the fixing belt 12, thereby providing a shorter warm-up time.

The fixing belt 12 may be an endless belt having a two-layer structure including a base layer comprised of nickel, stainless steel, polyimide, etc., and an elastic layer comprised of a silicone rubber, etc.

The heating roller 14 may be a hollow cylindrical roller made of aluminum, iron, etc., internally including a heater 14*h* such as a halogen heater, an induction heater, or the like. The wall of the heating roller 14 contains multiple heat pipes 14*a* stretching in the longitudinal or width direction of the heating roller 14, while the heat pipes 14*a* are evenly distributed within the cross-sectional plane. The heat pipes 14*a* accelerate thermal transfer from the heater 14*h* to the surface of the heating roller 14 so that the heating roller 14 can rapidly and uniformly heat the fixing belt 12.

The pressing roller 13 may be a cylindrical roller made of made of aluminum, iron, etc., covered with an elastic layer comprised of a silicone rubber, etc. The pressing roller 13 can be heated by a heater 13*h* disposed within the pressing roller 13 during fixing operation, if needed.

Upon driving of the fixing device 100, the fixing roller 11 can be driven to rotate clockwise in FIG. 1 by an external driving power. In association with rotation of the fixing roller 11, the fixing belt 12 rotates clockwise in FIG. 1, i.e., in a direction in which the sheet P is discharged, while a tension roller 15 applies a proper tension to the fixing belt 12. Alternatively, the pressing roller 13 can be driven to rotate counterclockwise in FIG. 1 so that the fixing roller 11 rotates clockwise in FIG. 1 in association with rotation of the pressing roller 13, and the fixing belt 12 rotates in association with rotation of the fixing roller 11.

During fixing operation, the fixing belt 12 is heated by the heater 14*h* until a thermistor detects a predetermined temperature (e.g., an appropriate temperature for fixing toner images).

The fixing device 100 further includes a nip pressure applying mechanism 30, not shown in FIG. 1, that controls the contact state of the pressing roller 13 with the fixing roller 11 with the fixing belt 12 therebetween.

Figure 2:
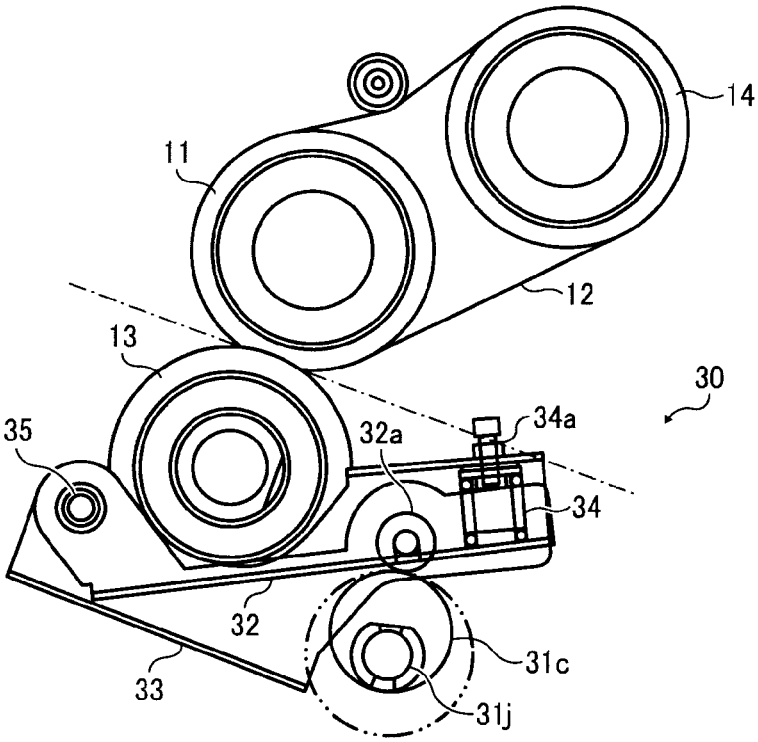
FIG. 2 and FIG. 3 are lateral and overhead schematic views, respectively, illustrating a nip pressure applying mechanism in the fixing device.
Figure 3:
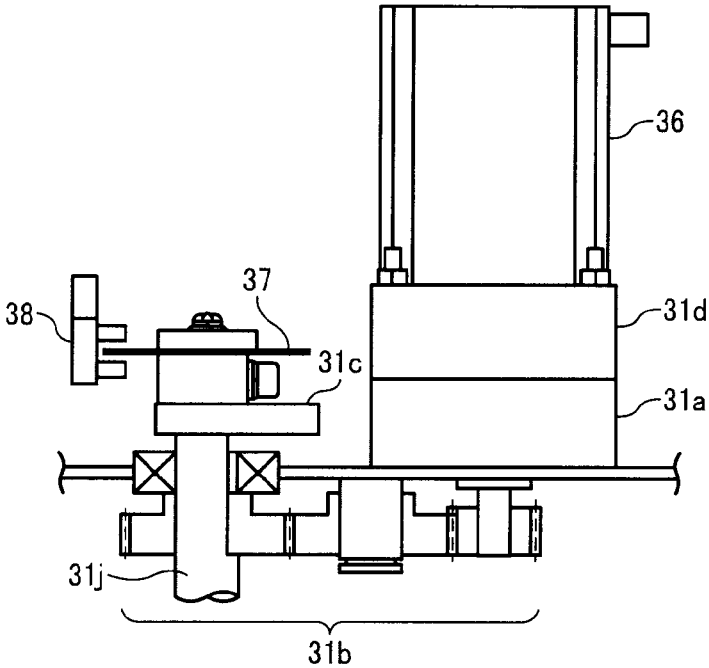

FIG. 2 and FIG. 3 are lateral and overhead schematic views, respectively, illustrating an embodiment of the nip pressure applying mechanism 30.

Referring to FIG. 2, the nip pressure applying mechanism 30 includes a first pressure arm 32 and a second pressure arm 33. Referring to FIG. 3, the nip pressure applying mechanism 30 includes and an actuator 36 and a drive transmission mechanism 31*b*. The second pressure arm 33 is a supporting member that movably supports the pressing roller 13 so that the pressing roller 13 can be either pressed against or drawn away from the fixing roller 11. The first pressure arm 32 is a driving member that is connected to the second pressure arm 33 via an elastic body 34. The actuator 36 drives upon electric power supply, and is able to maintain the stop position. The drive transmission mechanism 31*b* transmits drive of the actuator 36 to the first pressure arm 32 so that the first pressure arm 32 presses the pressing roller 13 and the pressing roller 13 further presses the fixing roller 11 at a predetermined nip pressure.

The elastic body 34 is a spring fixed between one end of the first pressure arm 32 and one end of the second pressure arm 33. A support shaft 35 is fixed to a flame of the fixing device 100 and pivotally supports the other ends of the first pressure arm 32 and the second pressure arm 33. The elastic body 34 includes a pressure adjuster 34*a* on the second-pressure-arm-33 side. The pressure adjuster 34*a* is comprised of a screw and a locknut.

A pressure cam 31*c* is rotated by drive of the actuator 36 while supporting the first pressure arm 32. The first pressure arm 32 is equipped with a cam follower 32*a* on the position supported with the pressure cam 31*c*. The drive of the actuator 36 is transmitted to the first pressure arm 32 and is transformed into a change in the position supported with the pressure cam 31*c*.

The pressure cam 31*c*, the first pressure arm 32, the second pressure arm 33, the elastic body 34, and the support shaft 35 are disposed on both ends of the pressing roller 13 in the longitudinal direction, composing a pair of cam devices. The pressure cams 31*c* on both ends are connected by a cam driving shaft 31*j*, and are rotated in conjunction with rotary drive of the cam driving shaft 31*j*.

Referring to FIG. 3, the nip pressure applying mechanism 30 includes the actuator 36, a deceleration mechanism 31*a*, an electromagnetic clutch 31*d*, and the drive transmission mechanism 31*b*. As described above, the actuator 36 drives upon electric power supply, and is able to maintain the stop position. The deceleration mechanism 31*a* amplifies drive torque of the actuator 36. The electromagnetic clutch 31*d* transmits drive of the actuator 36 to the deceleration mechanism 31*a*. The drive transmission mechanism 31*b* is a gear that transmits rotary drive of the actuator 36 (or the deceleration mechanism 31*a*) to the cam driving shaft 31*j*. Preferably, the actuator 36 is a stepping motor which can be rotary-driven for a desired angle.

The cam driving shaft 31*j* is equipped with a disk-shaped encoder 37. An optical sensor 38 reads rotational position of the encoder 37 to detect the cam phase of the pressure cam 31*c* to detect whether the fixing nip portion N is in pressurized or released condition. The actuator 36 can be stopped at an arbitral position so that the fixing nip portion N can be in an arbitral condition, according to the detected cam phase of the pressure cam 31*c*.

How the pressing roller 13 is pressed against the fixing roller 11 is described in detail below with reference to FIG. 4.

First, the actuator 36 starts rotary-driving upon electric power supply, and the drive transmission mechanism 31*b* transmits the drive to the cam driving shaft 31*j*. The cam driving shaft 31*j* then starts rotating, and the pressure cam 31*c* rotates certain degrees counterclockwise in FIG. 4, pressing up the cam follower 32*a* of the first pressure arm 32 in a direction indicated by an arrow (1) in FIG. 4.

Figure 4:
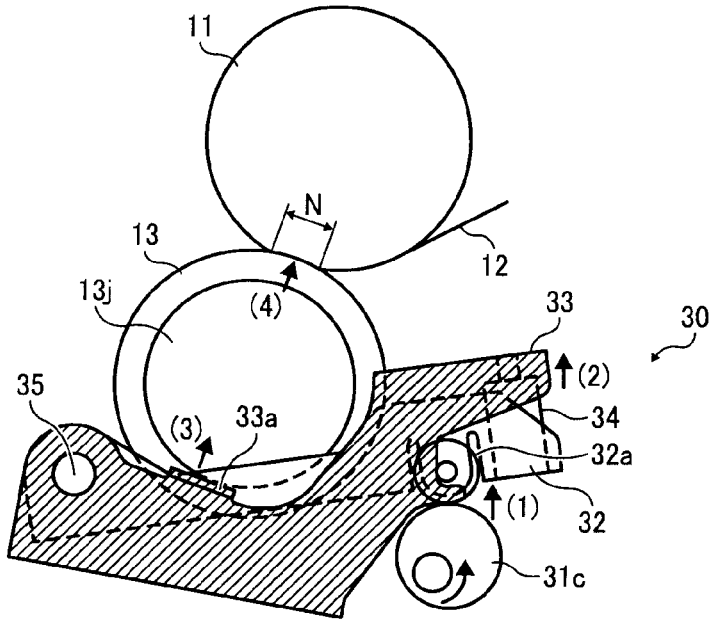
FIG. 4 is a schematic view for explaining how a pressing roller is pressed against or drawn away from a fixing belt.

Upon pressing up of the cam follower 32*a*, the first pressure arm 32 rotates counterclockwise in FIG. 4 on the support shaft 35. The elastic body 34 fixed on the opposite end of the first pressure arm 32 also rotates counterclockwise in FIG. 4 on the support shaft 35, pressing up the elastic-body-34-side end of the second pressure arm 33 in a direction indicated by an arrow (2) in FIG. 4.

Upon pressing up of the elastic-body-34-side end of the second pressure arm 33, the second pressure arm 33 rotates counterclockwise in FIG. 4 on the support shaft 35.

A pressing part 33*a* of the second pressure arm 33 provided between the elastic-body-34-side end and the support shaft 35 is then brought into contact with a roller shaft 13*j* of the pressing roller 13, pressing the pressing roller 13 in a direction indicated by an arrow (3) in FIG. 4.

While the pressing part 33*a* of the second pressure arm 33 presses the roller shaft 13*j* in the direction indicated by an arrow (3) in FIG. 4, the pressing roller 13 is pressed against the fixing roller 11 with the fixing belt 12 therebetween in a direction indicated by an arrow (4) in FIG. 4, forming the fixing nip portion N. When the elastic force of the elastic body 34 balances the reaction force between the pressing roller 13 and the fixing roller 11, the elastic body 34 undergoes deflection. When the pressure cam 31*c* reaches its top dead point along with rotation of the second pressure arm 33, the nip pressure between the fixing roller 11 and the pressing roller 13 becomes maximal. More specifically, when the pressure cam 31*c* presses up the first pressure arm 32 at its top dead point, the second pressure arm 33 is biased by the elastic body 34 so that the pressing roller 13 and the fixing roller 11 form the fixing nip portion N at the maximum nip pressure.

FIG. 2 illustrates the above-described condition in which the pressing roller 13 is pressed against the fixing roller 11.

A part of the nip pressure is attributable to operational factors and the other part thereof is attributable to non-operational driving factors. The contribution ratio therebetween can be controlled by the pressure adjuster 34*a*. Additionally, in a case in which the nip pressure is unsatisfactory even when the second pressure arm 33 is at the maximum, the nip pressure can be reset by the pressure adjuster 34*a*.

As described above, during fixing operation of the fixing device 100, the pressing roller 13 is pressed against the fixing roller 11 at a predetermined pressure by the nip pressure apply mechanism 30 so long as electric power is supplied to the actuator 36.

Next, how the pressing roller 13 is drawn away from the fixing roller 11 is described in detail with reference to FIG. 4.

First, the pressure cam 31*c* further rotates certain degrees from the position at which the pressing roller 13 is pressed against the fixing roller 11. The cam follower 32*a* of the first pressure arm 32 is then released from the pressure from the pressure cam 31*c* in the opposite direction indicated by an arrow (1) in FIG. 4.

The first pressure arm 32 released from the pressure from the pressure cam 31*c* then rotates clockwise in FIG. 4 on the support shaft 35 along with a repulsive force transmitted via the fixing nip portion N, the pressing part 33*a*, and the elastic body 34. The elastic body 34 is also released from the elastic force. The elastic-body-34-side end of the second pressure arm 33 is then drawn down in the opposite direction indicated by an arrow (2) in FIG. 4 along with the elastic body 34. Also, the elastic-body-34-side end of the second pressure arm 33 is pressed down in the opposite direction indicated by an arrow (2) in FIG. 4 by its own weight and the weight of the pressing roller 13.

Upon drawing down of the elastic-body-34-side end of the second pressure arm 33, the second pressure arm 33 rotates clockwise in FIG. 4 on the support shaft 35.

The pressing part 33*a* of the second pressure arm 33 provided between the elastic-body-34-side end and the support shaft 35 then rotates clockwise in FIG. 4 to draw away from the roller shaft 13*j* of the pressing roller 13 in the opposite direction indicated by an arrow (3) in FIG. 4.

The pressing roller 13 thus released from the pressure is drawn away from the fixing roller 11 in the opposite direction indicated by an arrow (4) in FIG. 4, releasing the fixing nip portion N.

As described above, during stopping operation of the fixing device 100, the pressure between the fixing roller 21 and the pressing roller 13 is released, and therefore the pressing roller 13 is drawn away from the fixing belt 12.

The nip pressure applying mechanism 30 is able to vary the distance between the fixing belt 12 and the pressing roller 13 when they are drawn apart. Specifically, the optical sensor 38 reads rotational position of the encoder 37 to detect the cam phase of the pressure cam 31*c* to detect the distance between the fixing belt 12 and the pressing roller 13 when the fixing nip portion N is in released condition. The actuator 36 can be stopped at an arbitral position according to the detected cam phase of the pressure cam 31*c* so that the distance between the fixing belt 12 and the pressing roller 13 becomes a desired amount.

Figure 5:
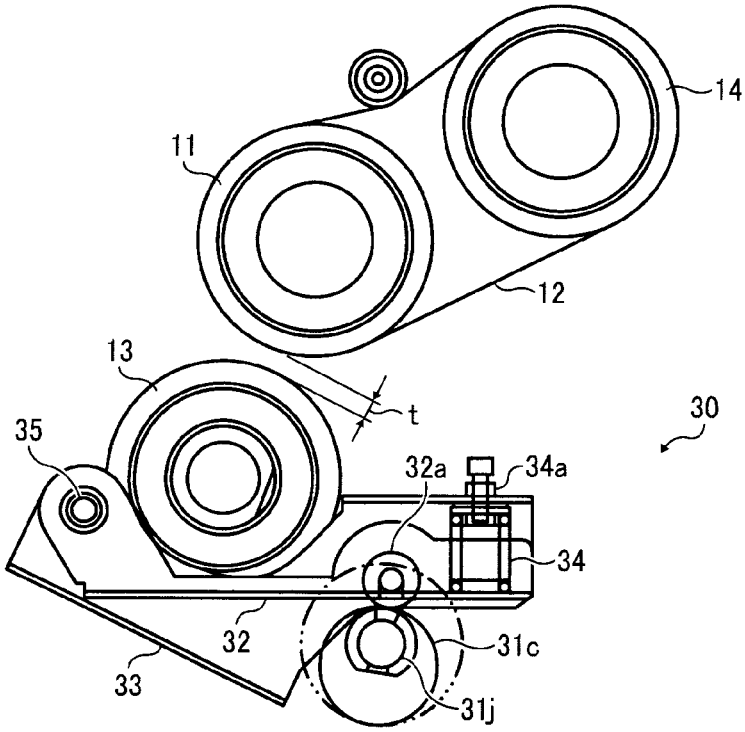
FIG. 5 schematically illustrates the nip pressure applying mechanism in a condition in which a pressing roller is drawn away from a fixing belt.

FIG. 5 illustrates the above-described condition in which the pressing roller 13 is drawn away from the fixing belt 12.

The pressing roller 13 is kept drawn away from the fixing belt 12 for a predetermined distance of t so that the pressing roller 13 does not receive radiation heat from the fixing belt 12 to prevent blistering during image forming operation.

The elastic body 34 exerts its elastic force only when applying the nip pressure. When releasing the nip pressure, the elastic body 34 also releases its elastic force. The nip pressure can be released without increasing load to the elastic body 34. When releasing the nip pressure, the actuator 36 needs a relatively small rotary torque for driving the cam device, and therefore the actuator 36 can be compact.

Since the nip pressure can be applied when the elastic body 34 exerts its maximum tensional force, the nip pressure applying mechanism 30 needs not exert a large driving force. Therefore, the driving mechanism (i.e., the actuator 36) can be compact. Since such a compact driving mechanism applies a small load to the elastic body 34, the first pressure arm 32, and the second pressure arm 33, these members need not have high mechanical strength and can be light in weight. Thus, the elastic body 34, the first pressure arm 32, and the second pressure arm 33 are prevented from deforming for an extended period of time, resulting in highly durable fixing device 100.

The nip pressure applying mechanism 30 can vary the nip pressure by controlling travel distances of the first pressure arm 32 and the second pressure arm 33 by controlling the cam phase of the pressure cam 31*c*.

In the fixing nip portion N, the nip pressure continuously varies according to variation in cam phase of the pressure cam 31*c*. The optical sensor 38 reads rotational position of the encoder 37 mounted on the cam driving shaft 31*j* to detect the cam phase of the pressure cam 31*c*. By previously compiling the relation between the cam phase of the pressure cam 31*c* and the nip pressure, the nip pressure can be set to an arbitral value by setting the pressure cam 31*c* to an arbitral cam phase. At the same time, the nip pressure applying mechanism 30 preferably controls the nip pressure by controlling the cam phase of the pressure cam 31*c* such that the deformation amount of the elastic body 34 or the fixing roller 11 at the fixing nip portion N become constant.

Preferably, the nip pressure applying mechanism 30 automatically adjusts the nip pressure by controlling the cam phase of the pressure cam 31 at the time the kind or size of the sheet P is changed. Thus, various kinds of papers (e.g., thin paper, thick paper) in various sizes are applicable to the fixing device 100.

In the fixing device 100, the nip pressure applying mechanism 30 presses the pressing roller 13 against the fixing belt 12 at a predetermined nip pressure while fixing operation is occurring, and draws the pressing roller 13 away from the fixing belt 12 for a predetermined distance before fixing operation occurs, in other words, before the sheet P enters into the fixing device 100 upon print request.

Such pressing and drawing operations in the fixing device 100 are described in detail below. In the below-described steps (S11) to (S14), the fixing belt 12 is in a standby mode in which the temperature is constantly controlled by the heater 14*h* of the heating roller 14. Additionally, the fixing belt 12 remains stationary while the fixing roller 11 and the pressing roller 13 are drawn apart for a predetermined distance to prevent blistering.

(S11) The image forming apparatus (to be described in detail later) receives a signal of a print job upon print request. According to the print request, image forming conditions (such as fixing conditions, two-sided or one-side image forming conditions, the kind and thickness of the sheet P, the temperature of the fixing belt 12, and the nip pressure at the fixing nip portion N) are properly set.

(S12) The fixing device 100 starts preliminary operation according to the image forming conditions set in the step S11. For example, the fixing roller 11 is driven to rotate to further rotate the fixing belt 12, while the temperature of the fixing belt 12 is controlled by the heater 14*h*.

(S13) Simultaneously, the nip pressure applying mechanism 30 adjusts the distance t between the fixing belt 12 and the pressing roller 13 according to the image forming conditions set in the step S11.

Specifically, the distance t between the fixing belt 12 and the pressing roller 13 is preferably determined as follows.

(a) When t1 represents the distance when the pressing roller 13 contacts a side of the sheet P which has a toner image thereon (in two-sided image forming operation) and t2 represents the distance when the pressing roller 13 contacts a side of the sheet P which has no toner image (in one-side image forming operation), t1>t2 is satisfied.

(b) When t3 represents the distance when the sheet P is a coated paper and t4 represents the distance when the sheet P is a non-coated paper such as normal paper, t3>t4 is satisfied.

(c) When t5 represents the distance when the sheet P has a thickness not less than d and t6 represents the distance when the sheet P has a thickness less than d, t5>t6 is satisfied.

(d) When t7 represents the distance when a humidity detector mounted on the image forming apparatus (preferably near the fixing device 100) senses a humidity not less than s and t8 represents the distance when the humidity detector senses a humidity less than s, t7>t8 is satisfied.

Each of the above-described distances t1, t3, t5, and t7 is a distance necessary for preventing temperature increase of the pressing roller 13 so as not to cause blistering.

(S14) After the termination of the preliminary operation, the nip pressure applying mechanism 30 presses the pressing roller 13 against the fixing roller 11 with the fixing belt 12 therebetween, forming the fixing nip portion N with a predetermined nip pressure. Simultaneously, the fixing device 100 is driven to start image forming operation at a predetermined speed.

Even when blistering may occur with high probability due to the fixing conditions (such as two-sided or one-side image forming conditions, the kind and thickness of the sheet P, and humidity around the fixing device 100), the occurrence of blistering can be prevented by the above-described drawing operations, i.e., drawing the pressing roller 13 away from the fixing belt 12 to prevent the pressing roller 13 from temperature increase. By contrast, when toner blistering may occur with low probability due to the fixing conditions, the pressing roller 13 needs not be drawn away from the fixing belt 12 so much. In this case, the fixing device 100 needs a much shorter time to be ready for printing.

Figure 6:
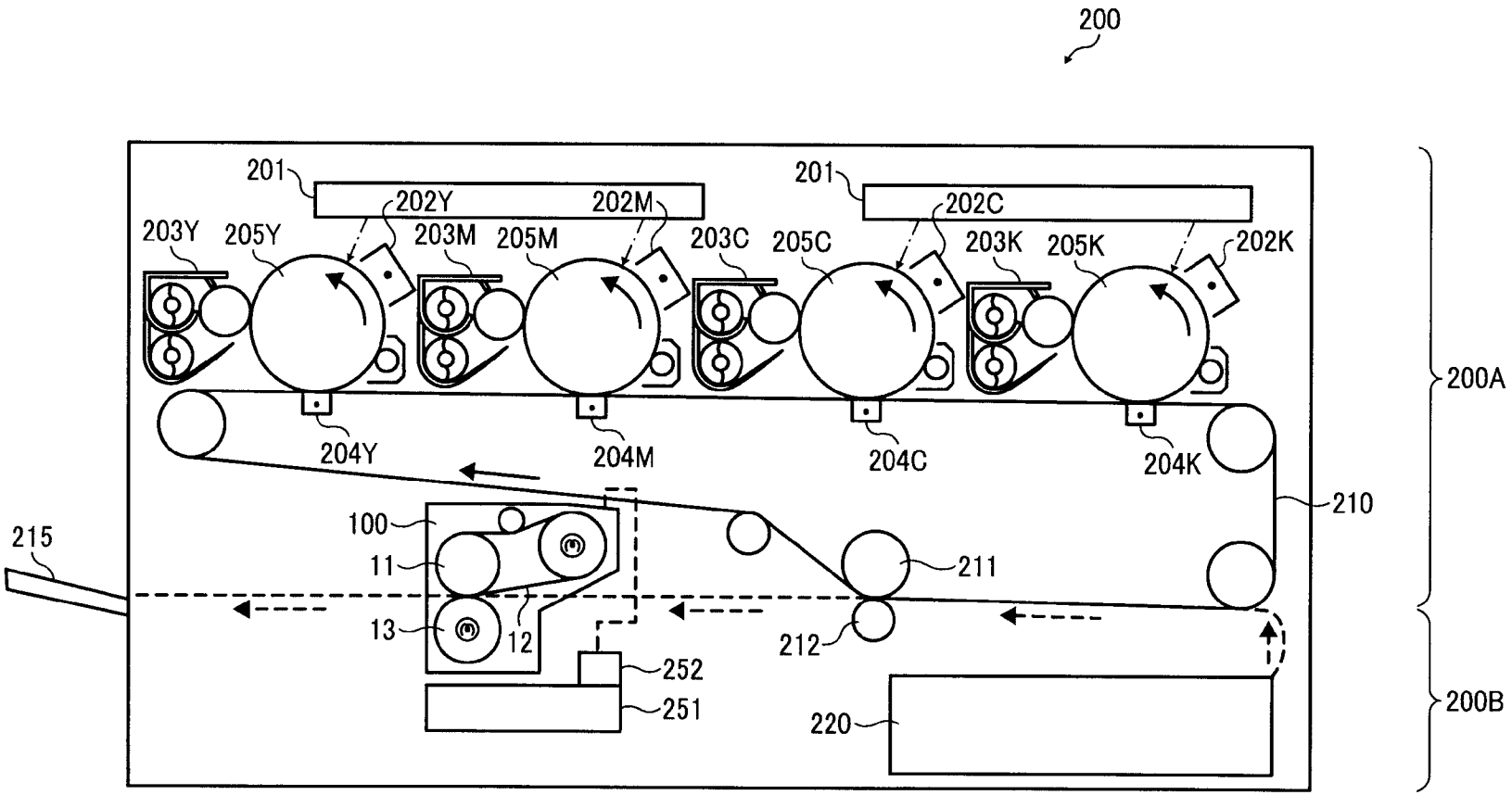
FIG. 6 is a cross-sectional schematic view illustrating a tandem full-color image forming apparatus according to exemplary embodiments of the invention.

FIG. 6 is a cross-sectional schematic view illustrating a tandem full-color image forming apparatus according to exemplary embodiments of the invention.

An image forming apparatus 200 is a high-speed color copier including an image forming part 200A, a paper feeding part 200B below the image forming part 200A, and an image reading part above the image forming part 200A, not shown. The image forming part 200A includes the above-described fixing device 100 according to exemplary embodiments of the invention.

The image forming part 200A further includes a transfer belt 210 having a transfer surface stretching in a lateral direction, and photoconductors 205Y, 205M, 205C, and 205K arranged along the transfer surface of the transfer belt 210. The photoconductors 205Y, 205M, 205C, and 205K bear toner images of yellow, magenta, cyan, and black, respectively, which are complementary colors of color separation colors.

The photoconductors 205Y, 205M, 205C, and 205K are each rotatable in the same direction (counterclockwise in FIG. 6). Around the photoconductors 205Y, 205M, 205C, and 205K, writing devices 201, charging devices 202Y, 202M, 202C, and 202K, developing devices 203Y, 203M, 203C, and 203K, primary transfer devices 204Y, 204M, 204C, and 204K, and cleaning devices are disposed. The developing devices 203Y, 203M, 203C, and 203K contain respective toners of yellow, magenta, cyan, and black.

The transfer belt 210 is stretched across driving rollers and driven rollers and is movable in the same direction at each portion facing the photoconductors 205Y, 205M, 205C, and 205K. A transfer roller 212 is disposed facing a driven roller 211. A sheet P is laterally fed from the transfer roller 212 to the fixing device 100.

An oil tank 251 that collects an oil for releasing the sheet P from the fixing device 100 and an oil pump 252 that resupplies the oil from the oil tank 251 to the fixing device 100 are disposed near the fixing device 100.

The paper feeding part 200B includes a paper feeding tray 220 and a feeding mechanism that separates the sheet P one by one from the paper feeding tray 220 toward the transfer roller 212.

In image forming operation, a surface of the photoconductor 205Y is uniformly charged by the charging device 202Y, and an electrostatic latent image is formed thereon based on image information read by the image reading part. The electrostatic latent image is developed into a yellow toner image in the developing device 203Y, and the yellow toner image is then primarily transferred onto the transfer belt 210 by the primary transfer device 204Y. Similarly, magenta, cyan, and black toner images are formed on the respective photoconductors 205M, 205C, and 205K. Each of the toner images is sequentially and electrostatically transferred onto the transfer belt 210 and superimposed on one another, forming a composite toner image T.

The composite toner image T is then transferred onto the sheet P fed by the driven roller 211 and the transfer roller 212. The sheet P having the composite toner image T thereon is fed to the fixing device 100, and the toner image T is fixed on the sheet P at the fixing nip portion N formed between the fixing belt 12 and the pressing roller 13.

Since the oil applicators 21 and 22 apply an oil to the fixing belt 12 and the pressing roller 13, respectively, and the separation claws 16*a* and 16*b* are disposed on the discharging side of the fixing nip portion N, the sheet P is discharged from the fixing nip portion N without winding around the fixing belt 121 and/or the pressing roller 13.

The sheet P discharged from the fixing nip portion N is then fed to a stacker 215.

The fixing device 100 is applicable to various types of recording media (e.g., thin paper, thick paper) with various sizes. While the fixing device 100 is stopping operation, the fixing roller 11 and the pressing roller 13 are drawn apart to prevent deformation of the surface layers thereof. Before starting image forming operation, the pressing roller 13 is drawn away from the fixing belt 12 for a predetermined distance t so as to prevent temperature increase of the pressing roller 13 to prevent the occurrence of blistering. When blistering may occur with low probability due to the fixing conditions (such as two-sided or one-side image forming conditions, the kind and thickness of the sheet P, and humidity in the image forming apparatus 200), the pressing roller 13 is drawn away from the fixing belt 12 for a distance t', which is smaller than t. In this case, the image forming apparatus 200 needs a much shorter time to be ready for printing.

Additional modifications and variations of the present invention are possible in light of the above teachings. It is therefore to be understood that within the scope of the appended claims the invention may be practiced other than as specifically described herein.

For example, a fixing device in which the fixing nip portion N is formed with two rollers is also usable in place of the fixing device 100.

Figure 7:
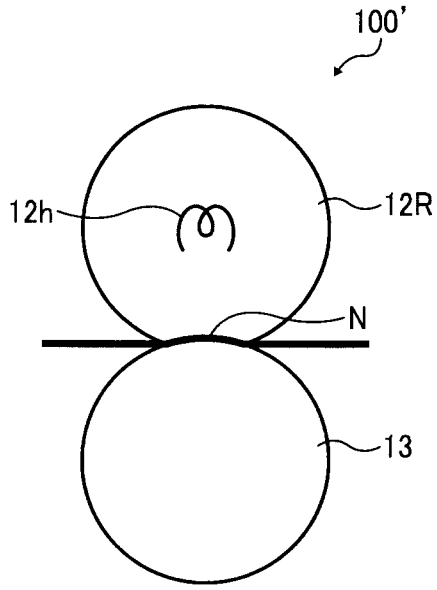
FIG. 7 is a cross-sectional schematic view illustrating another fixing device according to exemplary embodiments of the invention.

FIG. 7 is a cross-sectional schematic view illustrating another fixing device according to exemplary embodiments of the invention. The fixing device 100' includes a pressing roller 13 and a fixing roller 12R. The pressing roller 13 is pressed against the fixing roller 12R to form a fixing nip portion N therebetween. The fixing roller 12R is heated by a heater 12*h*. The nip pressure applying mechanism 30 is also mountable on the fixing device 100' and functions as the same manner as described above.

What is claimed is:

1. A fixing device, comprising:

a fixing member to fix a toner image on a recording medium, wherein the fixing member is rotatable;

a pressing member to press against the fixing member to form a nip portion therebetween, through which the recording medium passes; and a nip pressure applying mechanism that movably supports the pressing member, wherein the nip pressure applying mechanism presses the pressing member against the fixing member at a predetermined nip pressure during a fixing operation on a recording medium, and creates a gap between the pressing member and the fixing member of a predetermined distance before the initiation of the fixing operation on said recording medium, the predetermined distance being variably set depending on a condition for the fixing operation on said recording medium.

2. The fixing device according to claim 1, wherein the predetermined distance between the pressing member and the fixing member is set depending on a type of the recording medium.

3. The fixing device according to claim 2, wherein the predetermined distance between the pressing member and the fixing member is set smaller when the recording medium is a non-coated paper than when the recording medium is a coated paper.

4. The fixing device according to claim 1, wherein the predetermined distance between the pressing member and the fixing member is set based on a thickness of the recording medium.

5. The fixing device according to claim 4, wherein the predetermined distance is set smaller for recording media thinner than a predetermined threshold thickness than for recording media thicker than the predetermined threshold thickness.

6. The fixing device according to claim 1, further comprising a humidity detector, wherein the predetermined distance between the pressing member and the fixing member is set based on a humidity around the fixing device sensed by the humidity detector.

7. An image forming apparatus, comprising the fixing device according to claim 1.

8. A fixing device, comprising:

a fixing member to fix a toner image on a recording medium, wherein the fixing member is rotatable;

a pressing member to press against the fixing member to form a nip portion therebetween, through which the recording medium passes; and a nip pressure applying mechanism that movably supports the pressing member, wherein the nip pressure applying mechanism presses the pressing member against the fixing member at a predetermined nip pressure during a fixing operation, and draws the pressing member away from the fixing member for a predetermined distance before the initiation of the fixing operation, the predetermined distance being set depending on a condition for the fixing operation, wherein the predetermined distance between the pressing member and the fixing member is set smaller when the pressing member contacts a side of the recording medium having no toner image than when the pressing member contacts a side of the recording medium having the toner image.

* * * * *